US005518378A

United States Patent [19]

Neftel et al.

[11] Patent Number: 5,518,378

[45] Date of Patent: May 21, 1996

[54] CASSETTE-TYPE PERISTALTIQUE PUMP FITTED WITH AN UNDECEITFUL ASSEMBLY

[75] Inventors: Frederic Neftel, Paris; Bernard Bouvier, Eragny-sur-Oise, all of France

[73] Assignee: Debiotec S.A., Suisse, France

[21] Appl. No.: 325,261

[22] Filed: Feb. 9, 1995

[30] Foreign Application Priority Data

Apr. 30, 1992 [FR] France ..... 92 05402

[51] Int. Cl.[6] ..... F04B 43/08

[52] U.S. Cl. ..... 417/477.2; 417/477.1; 417/360

[58] Field of Search ..... 417/477.1, 477.2, 417/360

[56] References Cited

U.S. PATENT DOCUMENTS

| | | | |
|---|---|---|---|
| 4,673,334 | 6/1987 | Allington et al. | 417/477.2 |
| 4,735,558 | 4/1988 | Kienholz | 417/477.2 |
| 4,818,190 | 4/1989 | Pelmulder et al. | 417/360 |
| 4,904,168 | 2/1990 | Cavoto et al. | 417/477.2 |
| 5,044,902 | 9/1991 | Malbec | 417/477.2 |
| 5,266,013 | 11/1993 | Aubert et al. | 417/477.1 |

FOREIGN PATENT DOCUMENTS

| | | | |
|---|---|---|---|
| 0447909 | 9/1991 | European Pat. Off. . | |
| 2644212 | 9/1990 | France . | |
| 3912310 | 11/1989 | Germany | 417/477.1 |

*Primary Examiner*—Richard A. Bertsch
*Assistant Examiner*—Ted Kim
*Attorney, Agent, or Firm*—Nikaido, Marmelstein, Murray & Oram

[57] ABSTRACT

A peristaltic pump comprising a motor body (4), a cassette (1) with a casing (31) wherein are provided rotary rollers driven by a driving shaft (10) of the motor body (4) and which compress a deformable tube (25). The cassette further includes an error-preventing assembly having a platen (2) capable of taking either an active position where the driving shaft (10) actuates the rotary rollers (15) or a rest position where the rollers are fixed, and at east one finger (23) arranged on the lower part (14) of the cassette (1), the finger being capable of passing the platen (2) from the rest position to the active position.

8 Claims, 4 Drawing Sheets

CASSETTE-TYPE PERISTALTIQUE PUMP FITTED WITH AN UNDECEITFUL ASSEMBLY

The present invention relates to a cassette-type peristaltic pump fitted with an undeceitful assembly.

Peristaltic pumps as well as cassette-type peristaltic pumps are well-known in the technical world.

Cassettes comprise a casing designed for accommodating a deformable tube and rollers. When brought into motion, the rollers deform the tube, which causes the fluid contained in the tube to flow.

The rollers are driven by a motor block external to the cassette.

The patent FR-A-2.595.765 describes and illustrates a peristaltic pump comprising at least two elastic tubes arranged in parallel and a number of pressing rollers acting onto the elastic tubes. This pump aims at supplying a regular flow rate.

The patent FR-A-2.644.212 relates to a cassette for a peristaltic pump with deformable tube and the pump fitted with such a cassette. The cassette exhibits a casing containing in the vicinity of each end, a cylindrical runway against which bear and roll satellites which crush the deformable tube located between both runways. The cassette described and illustrated shows a simple and heavy duty construction.

The patent FR-A-2.644.522 relates to a peristaltic pump with a deformable tube containing, inside the housing, independent and deformable tube arches, which ensures reducing fluctuations on the instantaneous flow rate. The pump exhibits small space requirements.

We know that cassette-type peristaltic pumps are used more and more frequently in hospital environment since in certain applications, conventional drip cannot be considered.

The major problem raised by cassette-type peristaltic pumps of the prior art is that of the conditions of use.

All the cassettes are suitable for all kinds of peristaltic pump and it may thus happen that manipulation errors are made by the nursing staff.

The purpose of this invention is to suppress the possible errors of manipulation made by the nursing staff.

According to the present invention, the cassette is fitted with means which impose coupling a type of cassette with a type of pump.

More especially, the cassette-type peristaltic pump of this invention is fitted with an undeceitful assembly with avoids all possible errors of manipulation by the nursing staff.

The present invention thus offers a peristaltic pump comprising a motor body, a cassette with deformable tube and comprised of a casing wherein are provided rotary rollers driven by a driving shaft of the motor body and which compress the tube, said cassette being characterized in that it is comprised of an undeceitful assembly having a platen susceptible of taking either an active position wherein the driving shaft actuates the rotary rollers or a rest position wherein the rotary rollers are fixed and at least one finger arranged on the lower part of the cassette, the finger being capable of passing the platen from the rest position to the active position.

The present invention also relates to the features considered below one by one or according to all their technically possible combinations:

the motor body or the pump body comprises at least one groove whereas the platen comprises at least one slide susceptible of a transverse motion, whereas the penetration of the slide into the groove causes the system to lock in a rest position, whereby at least one finger of the casing actuates the slide to displace it and to allow the platen passing from one position to the other;

the slide is linked at least to one elastic element which returns it to the position of penetration into the groove of the pump body;

one finger of the cassette comprises a tilted plane designed for actuating the slide to cause it to move away from the position of penetration into the groove of the pump body;

every slid comprises a window designed to accommodate a finger of the cassette;

the platen comprises an upper plane surface, a cylindrical side flank, whereas the upper surface exhibiting a centre opening for the passage of the motor shaft and of the windows, each of them provided for the passage of one finger of the cassette, whereas the cylindrical side flank comprises notches, each provided for the passage of one slide, said slides moving in rails arranged in the lower surface of the platen;

the position of the window of each slide determines the type of the cassette susceptible to pass the platen from one of its positions to the other;

the pump comprises a cassette with an intake joining piece and an exhaust joining piece, each penetrated by a flexible hose and the cassette comprises a guiding-tube made of two cylindrical elements drilled in such a way to enable the circulation of the liquid, each exhibiting a male section penetrating into an end of the flexible hose and a male or female section designed for receiving an external hose, whereas the male joining piece ensuring the squeezing of the flexible hose in corresponding joining piece using at least one upper boss and one lower boss located at the end of the cassette;

both cylindrical elements are interdependent and comprise at least one claw to ensure their being fastened to the cassette.

Various advantages and characteristics of the present invention will be outlined by the following detailed description with the appended drawings on which:

Figure 1:
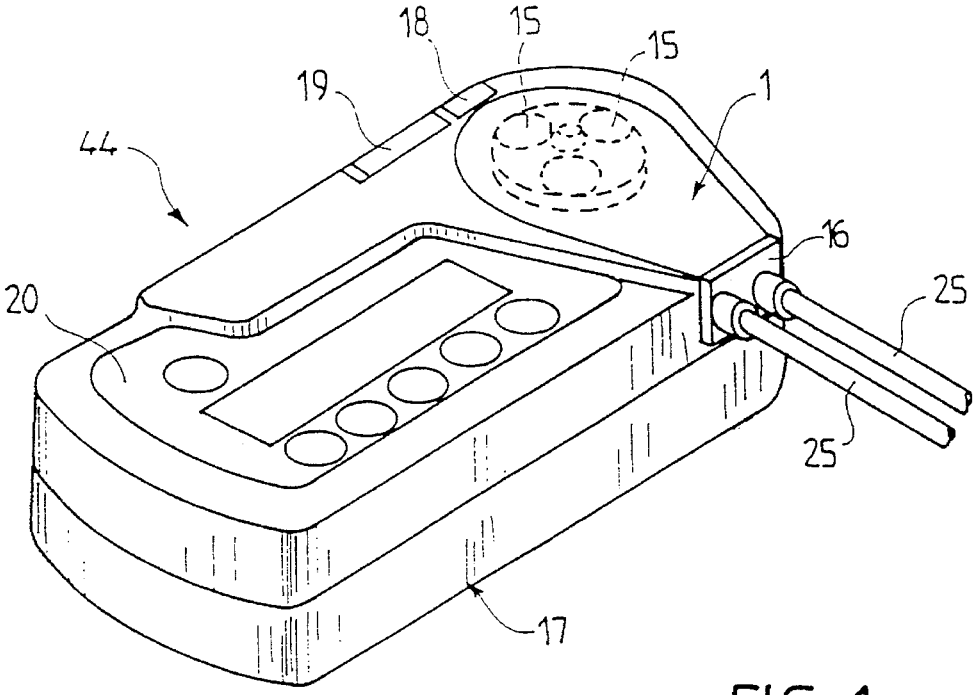
FIG. 1 is a view in perspective of a cassette-type peristaltic pump according to the invention.
Figure 2:
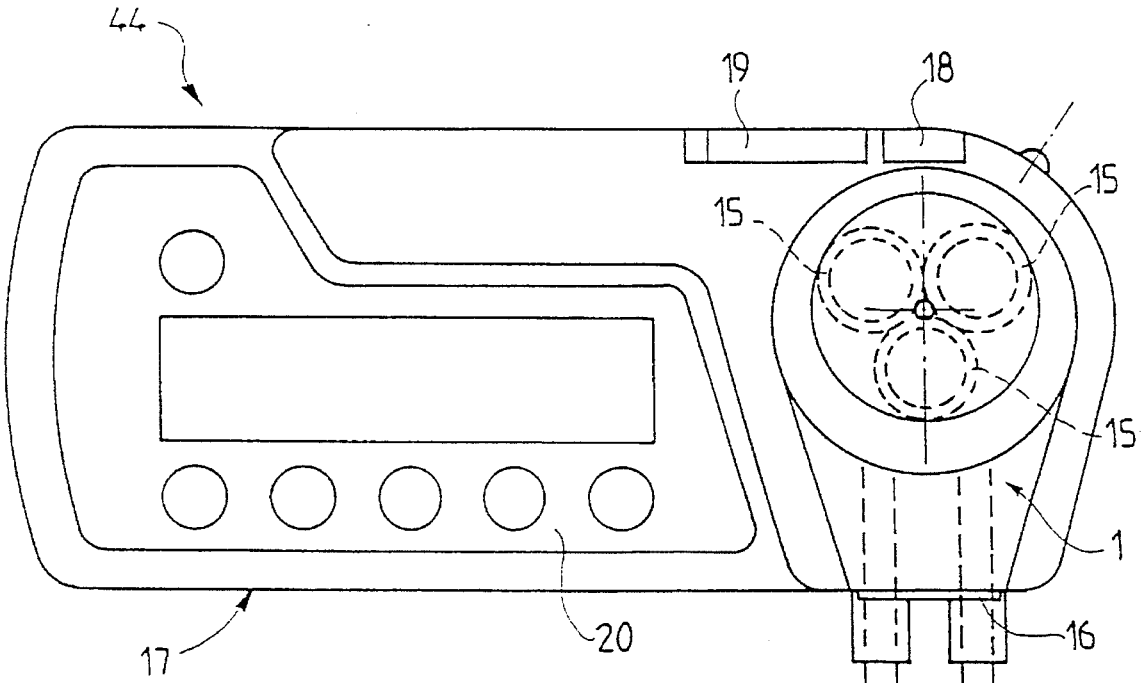
FIG. 2 is a view from above of the pump according to FIG. 1.

On the appended drawings where the same reference symbols designate analogical parts, the cassette-type peristaltic pump fitted with an undeceitful assembly is described globally by the number 44. As represented on FIGS. 1 and 2, it comprises a cassette 1 accommodated in a pump body 17. A deformable tube 25 is guided by a tube 16 and, during operation, rollers 15 compress the deformable tube 25. The cassette 1 comprises a surface on which the deformable tube 25 leans. It has been designed in order to comprise no sharp angles susceptible to cause early wear of the tube 25. In the example represented on FIGS. 1 and 2, there are rollers 15. This is here purely illustrative and, of course, the number of rollers 15 may vary at discretion. The peristaltic pump 44 exhibits a control panel 20 with a cassette ejection button 18 and a manoeuvrer button 19.

Figure 3:
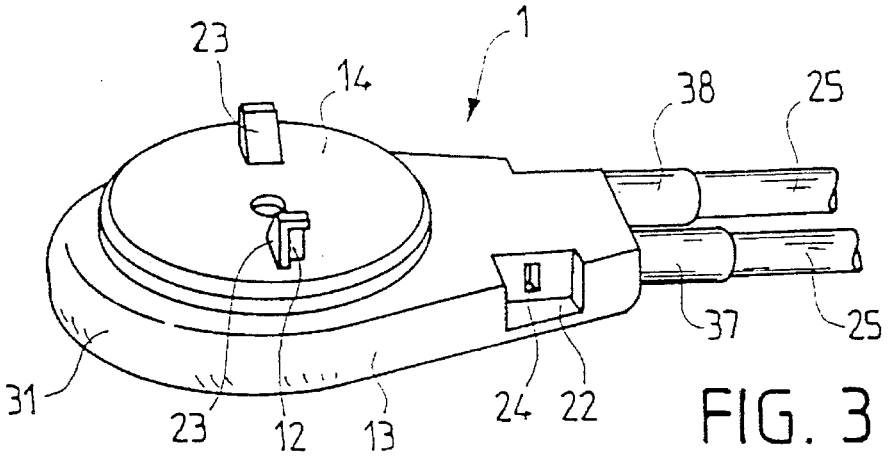
FIG. 3 is a view in perspective from under of a cassette according to the invention.

FIG. 3 shows one of the elements of the undeceitful assembly of this invention. On the example illustrated, we can see fingers 23 arranged at the lower part of the casing 31 of the cassette 1. The casing 31 of the cassette 1 comprises an upper part 13 and a lower part 14. The fingers 23 are each fitted with a boss 12 provided to cooperate in the opening of a slide, as it will be explained hereafter. The end of the cassette 1 comprises an intake joining piece 37 and an exhaust joining piece 38 in which passes the deformable tube 25.

Recesses 22 have been provided on the casing 31, in the vicinity of the joining pieces 37, 38 to accommodate infrared sensors which are used to detect the possible passage of air bubbles in the windows 24. The position of the recesses 22 thus ensures an undeceitful effect.

Figure 4:
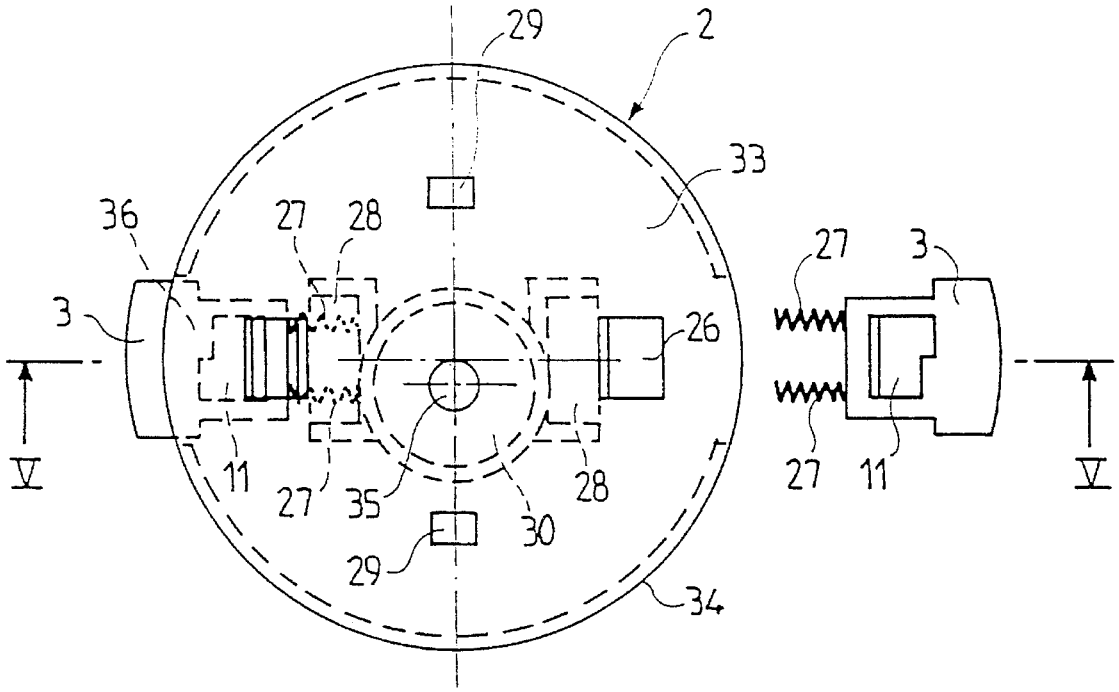
FIG. 4 is a view from under of a platen and of the slides.

FIG. 4 illustrate another element of the undeceitful assembly. This comprises the platen 2 and side slides. As illustrated, the platen 2 comprises a plane upper surface 33, a cylindrical side flank 34 with a centre opening 35 for the passage of the motor shaft which is guided in a trunk 30 of the platen 2. The platen 2 comprises on its plane upper surface 33 side windows 26 designed for the passage of the fingers 23 of the cassette 1.

The rails 28 are provided close to the trunk 30 at the lower surface of the platen 2 and their function will be specified hereafter. Cogs 29 designed to improve the fastening of the platen 2 are arranged opposite the trunk 30.

The platen 2 exhibits on the cylindrical side flank 34 notches 36 designed to enable the passage of a slide 3. Each slide 3 comprises an opening 11 and is linked to at least one elastic element 27.

Figure 5:
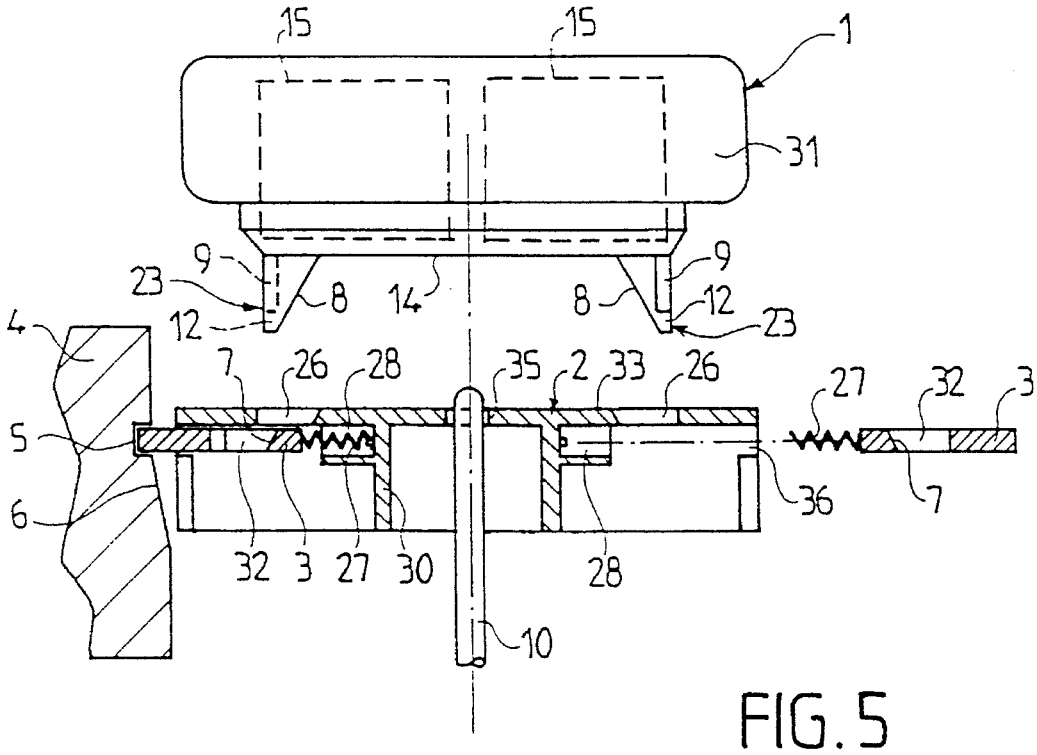
FIG. 5 is a cross section along the line V—V of FIG. 4 with representation of a cassette.

FIG. 5 represents on the left section the platen 2 with the slide 3 arranged in a groove 5 of the pump body 4. On the right section, the slide 3 is located away from the rail 28, whereas the elastic elements 27, for instance springs, have left the notches 36 of the cylindrical side flank 34. After the groove 5, the pump body 4 exhibits a section in the form of a ramp or tilted plane 6. The structure represented ensures maintaining the platen 2 in position, whereas the trunk 30 fairing the driving shaft 10.

Each slide 3 comprises a window 32 and a tilted plane 7 on section close to the elastic elements 27. We shall specify hereafter the cooperation and the operation between the cassette 1 and the platen 2, especially the effect produced by the insertion of the fingers 23 into the side windows 26 of the upper surface 33 of the platen 2.

As specified above, the casing 31 of the cassette 1 is fitted on its lower part 14 with fingers 23. These fingers 23 comprise three specific sections, a tilted plane 8 oriented to the outside, a cut-up 9 oriented to the outside and a boss 12 in the prolongation of the cut-up 9.

Figure 6:
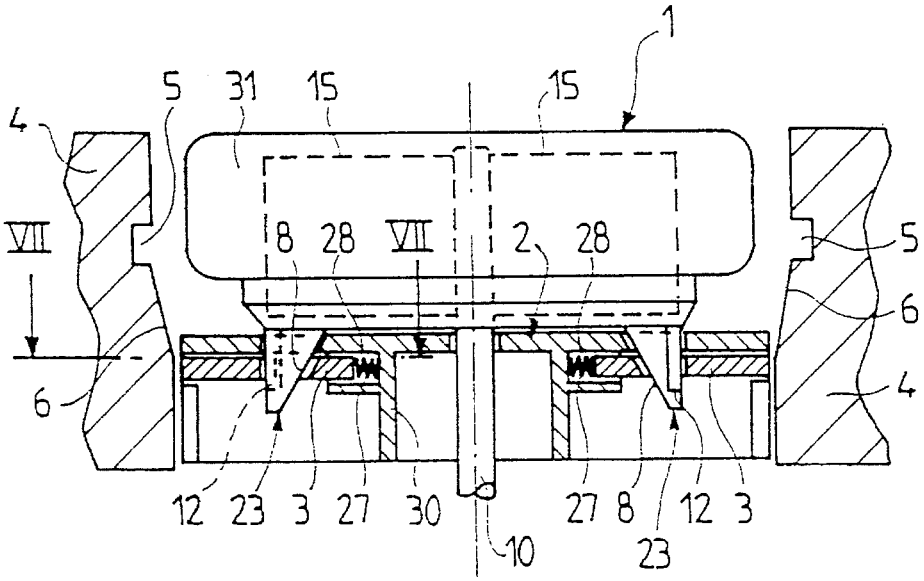
FIG. 6 is an axial section of a cassette-body assembly of a pump.

FIG. 6 shows the cooperation between the components of the undeceitful assembly, i.e. the platen 2 and the fingers 23 of the casing 31 of the cassette 1. After insertion of the fingers 23, the platen 2 has left the groove 5 of the pump body 4 while sliding along the tilted plane 6 of the pump body 4. The elastic elements 27 arranged in the rails 28 bear against the trunk 30 on which is guided the driving shaft 10. The fingers 23 can match the slides 3 thanks to the cooperation and the combination of the tilted planes 8 and of the bosses 12.

Figure 7:
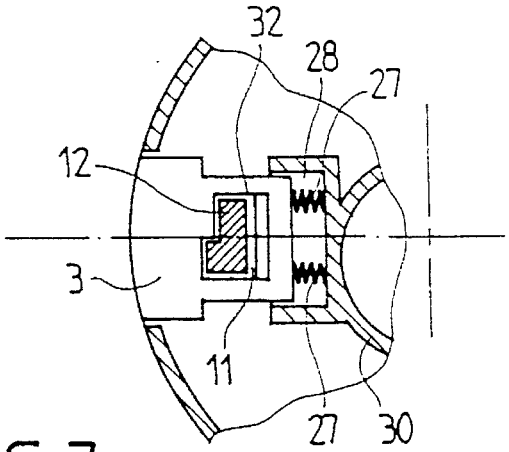
FIG. 7 is a section along the line VII—VII of FIG. 6.

FIG. 7 shows in detail the matching of a slide 3 in a rail 28 close to a trunk 30 of the platen 2 with the elastic elements 27. This figure shows especially the cooperation in the window 32 of the slide 3 of the boss 12 in the opening 11.

Figure 8:
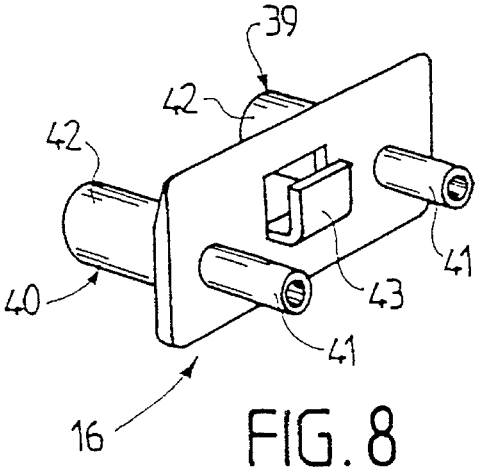
FIG. 8 is a view in perspective of a guiding tube.

FIG. 8 is a view in perspective of a guiding tube 16. As represented on this figure, the guiding tube 16 comprises two cylindrical elements 39,40 enabling the circulation of the liquid. The male section 41 penetrates one end of the flexible hose 25. The female section 42 is designed to receive an external hose and the male section 41 ensures the squeezing action of the flexible hose 5 in the matching joining piece 37, 38.

Both cylindrical elements 39, 40 are interdependent and comprise at least one claw 43 to allow their fastening onto the cassette 1. The guiding tube 16 can be made of a silicon-based material, it ensures stability of the tubes in front of the optical sensors which are used to check the piping for bubbles as well as the deformable tube 25 for tightness.

Figure 9:
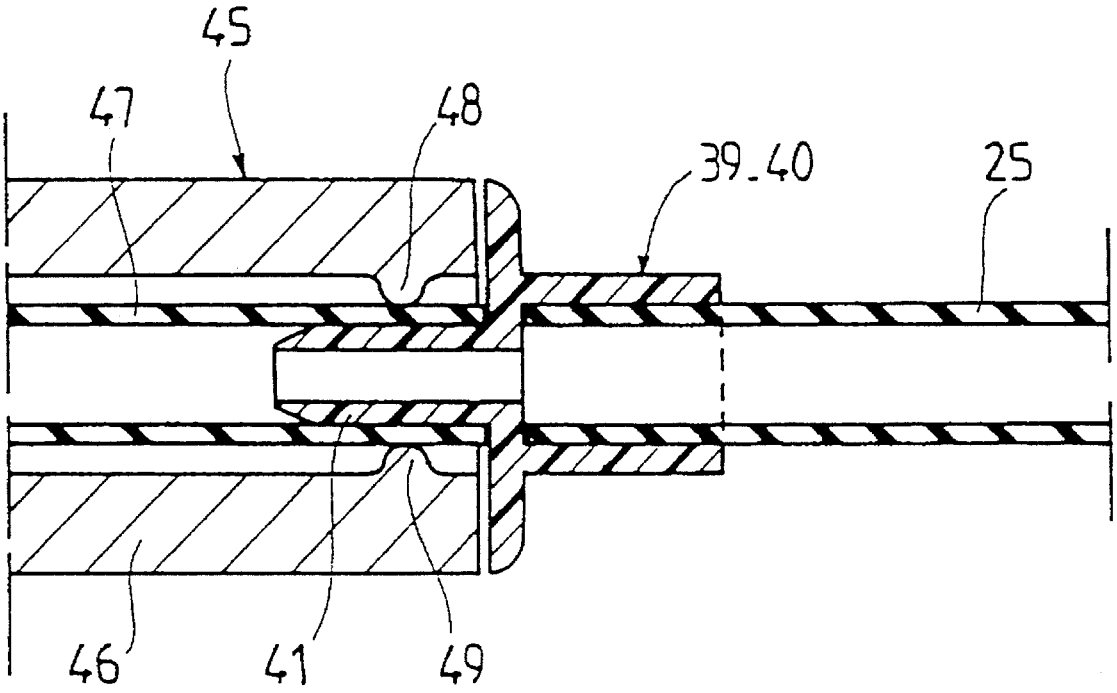
FIG. 9 is a cross section of the cassette end.

FIG. 9 is a cross section of the end of the cassette 1 illustrating the connection between the flexible hose and the hose(s) linked to the patient or the liquid used for a drip.

On the upper part 45 of the cassette end, an upper boss 48 has been foreseen, whereas the lower part 46 of the end of the cassette exhibits a lower boss 49. 47 designates the hose section subject to the crushing effect of the rollers.

We are now going to describe the operation of the cassette-type peristaltic pump fitted with an undeceitful assembly according to this invention.

In a rest position, the slide 3 is located in the groove 5 of the pump body 4 and the elastic elements 27 linked to said slide 3 are located in the rail 28 adjacent to the trunk 30 of the platen 2. In this position, the assembly is inactive and is thus resting.

In order to release the platen 2, a cassette 1 is inserted on the shaft 10 of the pump motor, the tilted plane 8 of the finger 23 of the cassette 1 causes the slide 3 to engage into the platen 2 by friction on the tilted plane 7 of the slide 3. Consequently, the platen 2 is released when the slide 3 is completely retracted from the groove 5 of the pump body 4. It can be understood easily that in the absence of cassette 1, the platen 2 is held in a rest position and is not susceptible of taking an active position.

After release of the platen 2, the cassette 1 drives the platen 2 downwards. The slide 3 skids down the tilted plane 6 of the pump body 4. The slide 3 is displaced sideways and rests in the cut-up 9 of the finger 23 of the cassette 1. There is thus a mechanic link between the platen 2 and the cassette 1.

In the active position in which the platen 2 is not interdependent with the grooves of the pump body 4 any longer, the driving shaft 10 bring the rollers 15 into rotation which then actuate the deformable tube 25 in order to supply the liquid contained in said deformable tube 25. The shape of the rollers 15 is not critical. One may select for the rollers 15 any appropriate cylindrical shape, barrel-shaped rollers can be considered quite readily.

The rest position or inactive position can be resumed by bringing the cassette 1 upwards and when the slides 3 reach the level of the grooves 5 of the pump body 4, there is an engaging effect which enables to separate the finger(s) 23 from the cassette 1, especially by way of the bosses 12 which move away from the window of a slide 3.

Driving the rollers 15 using the driving shaft 10 is only possible when the platen 2 is in active position. Only the cooperation of the platen 2 with the matching cassette 1 enabling to bring the platen 2 into an active position.

Thus acting on the shape and the cooperation of the bosses 12, the cut-ups 9 of the fingers 23 of the cassette 1 and the respective shape of the windows 32 of the slide 3 and the angle of the tilted plane 7 of the slid 3, one can produce a specific undeceitful assembly enabling to suit at least one peculiar type of cassette special to at least one also peculiar type of peristaltic pump, which avoids all errors of manipulation. This way, it is ensured that every cassette matches a set peristaltic pump.

As regards the undeceitful assembly, the slid 3 exhibits an opening 11 and the cassette 1 a boss 12 on the finger 23. According to the position of this opening 11 and to that of the boss 12 of the finger 23, the slide 3 may be retracted or stop against a cassette 1.

The invention is not limited to the embodiments represented and described in detail and various modifications may be made without betraying its basic framework.

The reference signs inserted after the technical characteristics mentioned in the claims solely aim at making the understanding of the said easier and do not limit their scope whatsoever.

We claim:

1. A peristaltic pump comprising a pump motor body having a driving shaft; a cassette including a deformable tube, a casing, and rotary rollers in the casing driven by said driving shaft of said pump motor body and compressing said tube; and an error-preventing assembly including a platen having an active position where the driving shaft of the motor body actuates the rotary rollers of the cassette and a rest position where the rotary rollers are fixed, and at least one finger arranged on the lower part of the cassette, the at least one finger being capable of passing the platen from the rest position to the active position.

2. The peristaltic pump according to claim 1, wherein said pump motor body has at least one groove; the platen comprises at least one slide slidably mounted thereon and capable of lateral motion relative to an upper plane surface of said platen; penetration of said at least one slide into said at least one groove causes said platen to be locked in the rest position, and engagement of said at least one finger with said at least one slide actuates the slide to move the slide out of said at least one groove and permit said platen to move from the rest position to the active position.

3. The peristaltic pump according to claim 2, further comprising an elastic element biasing each at least one slide into engagement with said at least one groove.

4. The peristaltic pump according to claim 2, wherein said at least one finger has a slant surface which engages said at least one slide to move the slide out of said at least one groove.

5. The peristaltic pump according to claim 2, wherein each said at least one slide has a window designed to receive said at least one finger.

6. The peristaltic pump according to claim 2, wherein said platen further comprises a lower surface and cylindrical side portions extending from said upper plane surface, said upper plane surface having a central opening for passage of said motor shaft and at least one window provided for passage of said at least one finger of said cassette, said cylindrical side portions having at least one notch provided for passage of said at least one slide, and said lower surface having rails in which said at least one slide moves.

7. The peristaltic pump according to claim 5 or claim 6, wherein the position of the window determines the type of cassette capable of passing the platen from one position to the other.

8. The peristaltic pump according to claim 1, wherein said cassette further comprises a tube guide, said tube guide including a pair of cylindrical connectors joined together, one of said cylindrical connectors acting as an intake joining piece, the other of said cylindrical connectors acting as an exhaust joining piece, each cylindrical connector having a male section penetrating one end of said deformable tube and a section extending in an opposite direction provided for connecting to an external tube; and bosses internally of said cassette engaging said ends of said deformable tube and said male sections of both connectors.

* * * * *

UNITED STATES PATENT AND TRADEMARK OFFICE

CERTIFICATE OF CORRECTION

PATENT NO. : 5,518,378

DATED : NEFTEL et al.

INVENTOR(S) : May 21, 1996

It is certified that error appears in the above-indentified patent and that said Letters Patent is hereby corrected as shown below:

On the title page:

Item [73], line [1], please delete "Suisse, France" insert therefor -- Lausanne 9, Suisse --.

Item [22] insert -- PCT Filed: April 22, 1993 --

Item [86] insert -- PCT No.: PCT/FR93/00397

§ 371 Date: Feb. 9. 1995

§ 102(e) Date: Feb. 9, 1995 --

Item [87] insert -- PCT Pub. No.: WO93/22560

PCT Pub. Date: Nov. 11, 1993 --

Signed and Sealed this

Fourteenth Day of January, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,518,378

DATED : May 21, 1996

INVENTOR(S) : NEFTEL et al.

It is certified that error appears in the above-indentified patent and that said Letters Patent is hereby corrected as shown below:

Item [73], delete "Debiotec S.A.," insert therefor – Debiotech S.A., –

Item [54], line 1, delete "PERISTALTIQUE" insert therefor – PERISTALTIC –

Signed and Sealed this

Twenty-second Day of April, 1997

Bruce Lehman

*Attest:*

BRUCE LEHMAN

*Commissioner of Patents and Trademarks*

*Attesting Officer*